US005910650A

United States Patent [19]

Castonguay et al.

[11] Patent Number: 5,910,650

[45] **Date of Patent: *Jun. 8, 1999**

[54] MANUAL CHARGING MECHANISM FOR INDUSTRIAL-RATED CIRCUIT BREAKER

[75] Inventors: Roger N. Castonguay, Terryville; James I. Smith, Avon, both of Conn.

[73] Assignee: General Electric Company, Schenectady, N.Y.

[ * ] Notice: This patent is subject to a terminal disclaimer.

[21] Appl. No.: 08/863,667

[22] Filed: May 27, 1997

[51] Int. Cl.[6] ..... H01H 5/00; H01H 1/52

[52] U.S. Cl. ..... 200/400; 200/323

[58] Field of Search ..... 200/50.01, 321, 200/323, 327, 400, 401; 218/154; 185/40 R

[56] References Cited

U.S. PATENT DOCUMENTS

| | | | |
|---|---|---|---|
| 3,084,238 | 4/1963 | Baskerville | 200/153 |
| 3,095,489 | 6/1963 | Baird | 200/153 |
| 3,729,065 | 4/1973 | Baskerville et al. | 185/39 |
| 4,167,988 | 9/1979 | Acampora et al. | 185/40 R |
| 4,672,501 | 6/1987 | Bilac et al. | 361/96 |
| 5,489,755 | 2/1996 | Castonguay et al. | 200/400 |
| 5,575,381 | 11/1996 | Castonguay et al. | 200/401 |

*Primary Examiner*—Wynn Wood Coggins
*Assistant Examiner*—Michael J. Hayes
*Attorney, Agent, or Firm*—Cantor Colburn LLP; Carl B. Horton

[57] ABSTRACT

An air circuit breaker closing spring charging mechanism includes a ratchet and pawl whereby the closing spring charging gear is protected from damage due to reverse rotation of the ratchet when the charged closing springs are later released. A locking latch prevents damage to the charging mechanism components and a latch release lever allows the charging mechanism to return to an operative position when the closing springs are later charged by a manually operated charging handle.

12 Claims, 5 Drawing Sheets

MANUAL CHARGING MECHANISM FOR INDUSTRIAL-RATED CIRCUIT BREAKER

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Springs in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism. As described within the aforementioned U.S. Pat. No. 4,167,988, the ratchet mechanism includes a driving pawl coupled with the motor operator for incrementally advancing a ratchet wheel coupled with the circuit breaker operating mechanism. Each incremental advance of the ratchet wheel is sustained by a holding pawl. Ultimately, the ratchet wheel is advanced to an angular position where the circuit breaker closing springs are fully charged and therefore empowered to forcibly close the circuit breaker contacts. Typically, the discharge of the closing springs rapidly drives the ratchet wheel in the same direction as did the driving pawl in charging the closing springs. In the process, the teeth on the ratchet wheel impact with the holding pawl, producing undue pawl and ratchet wear, as well as unnecessary stress on the pawl springs and mountings. Moreover, when the breaker contacts close, there is an inevitable rebound which tends to rotate the ratchet wheel in a reverse direction. Under these circumstances, the straight sides of the ratchet teeth impact against the straight edges of the holding pawl tip, causing potentially damaging stresses in the ratcheting mechanism. The patent further suggests the use of a holding prop to hold the pawl out of engagement with the ratchet wheel until the closing springs have filly discharged to protect the pawl and the ratchet wheel from potential damage. When the closing springs become discharged, the circuit breaker operating mechanism components are exposed to allow an operator to manually release the holding prop in order for the holding pawl to again become operative in re-charging the circuit breaker closing springs.

When a manual and motor controlled operating mechanism closing springs arrangement such as described in U.S. Patent Application Docket No. 41PR-7413 entitled "Ratcheting Mechanism for Industrial-Rated Circuit Breaker" filed concurrently herewith (May 27, 1997) is employed within an air circuit breaker operating mechanism, it is inconvenient for an operator to unlock the air circuit breaker enclosure to expose the operating mechanism components in order to manually access the closing prop.

Accordingly, one purpose of the instant invention is to provide a combined handle and motor operator for charging air circuit breaker closing springs by means of a ratchet and pawl arrangement. A further purpose of the invention is to hold the holding pawl away from the circuit breaker ratchet wheel during discharge of the circuit breaker closing springs to close the circuit breaker contacts. A still further purpose of the invention is to automatically return the ratchet and holding pawl into operative association with the circuit breaker closing springs charging shaft when the operating handle is later employed to charge the closing springs.

SUMMARY OF THE INVENTION

An air circuit breaker operating mechanism includes a ratchet and pawl arrangement. Upon completion of the charging operation and release of the closing springs, the ratchet and pawl become disengaged from the charging gear in response to a closing command. A latch release lever interacts with a locking latch and the circuit breaker operating handle to automatically re-engage the ratchet and pawl with the charging gear when the circuit breaker operating handle is rotated to manually charge the closing springs.

DESCRIPTION OF THE PREFERRED EMBODIMENT

Figure 1:
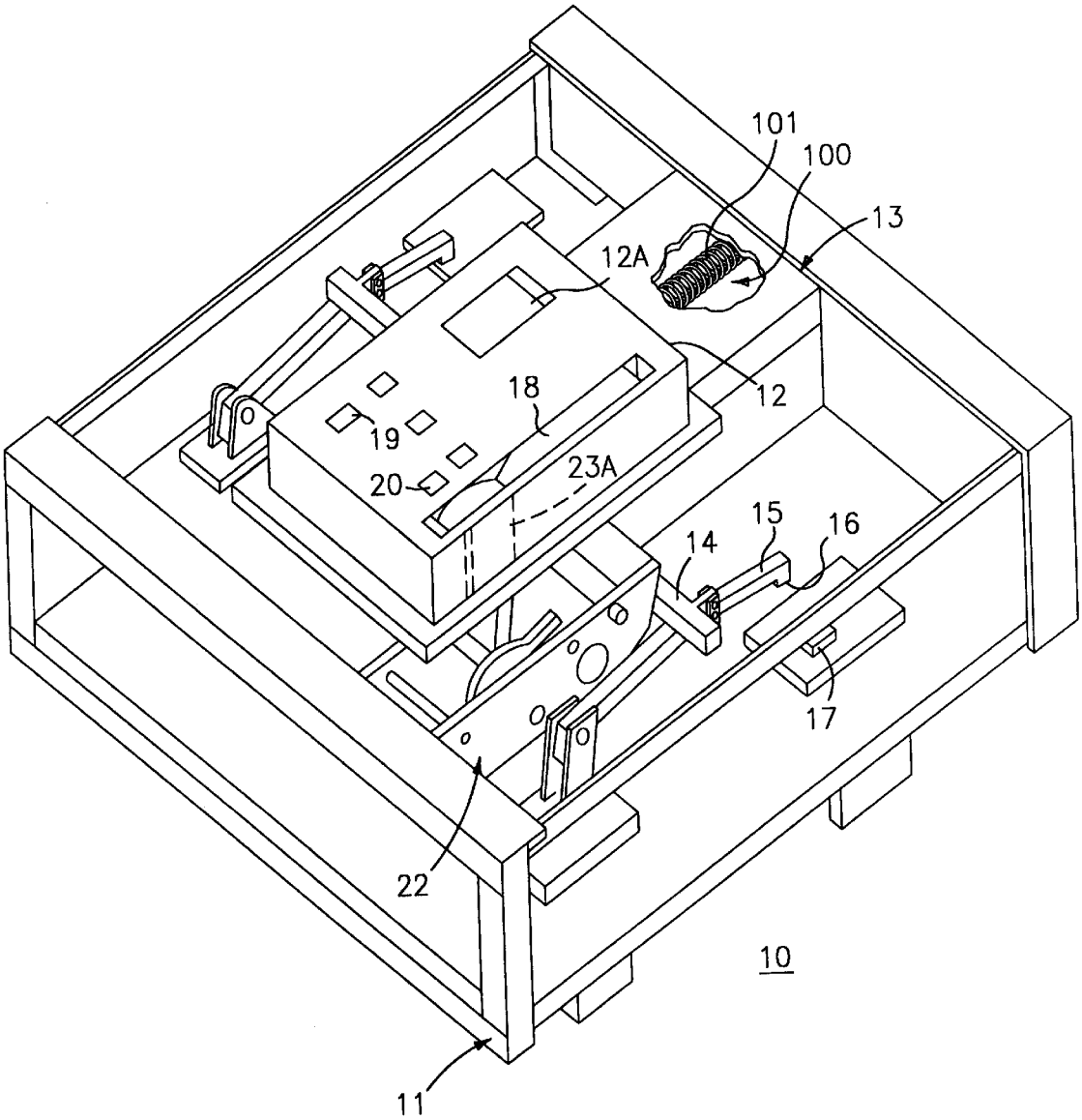
FIG. 1 is top perspective view of an air circuit breaker containing the closing springs manual charging arrangement in accordance with the invention.

The air circuit breaker 10 of FIG. 1 is similar to that described within the aforementioned U.S. Pat. No. 3,095,489 and includes a metal frame 11 which supports the circuit breaker cover 12, that houses the trip unit programmer 12A, and the operating mechanism enclosure 13. The trip unit programmer is similar to that described in U.S. Pat. No. 4,672,501 entitled "Circuit Breaker and Protective Relay Unit". The top cover 12 includes a trip button 19 for releasing the circuit breaker operating mechanism contained within the enclosure 13 for separating the circuit breaker contacts 16, 17 to their open condition and a closing button 20 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The ratchet mechanism 22 improves over the earlier mechanism described in the aforementioned U.S. Pat. No. 4,167,988 by allowing the operating mechanism 100 closing spring 101 described therein to be charged remotely by means of a motor operator as well as by means of the circuit breaker operating handle 18 that interacts with the ratchet mechanism 22 by means of a pair of plate connectors, one of which is indicated at 23A.

Figure 1A:
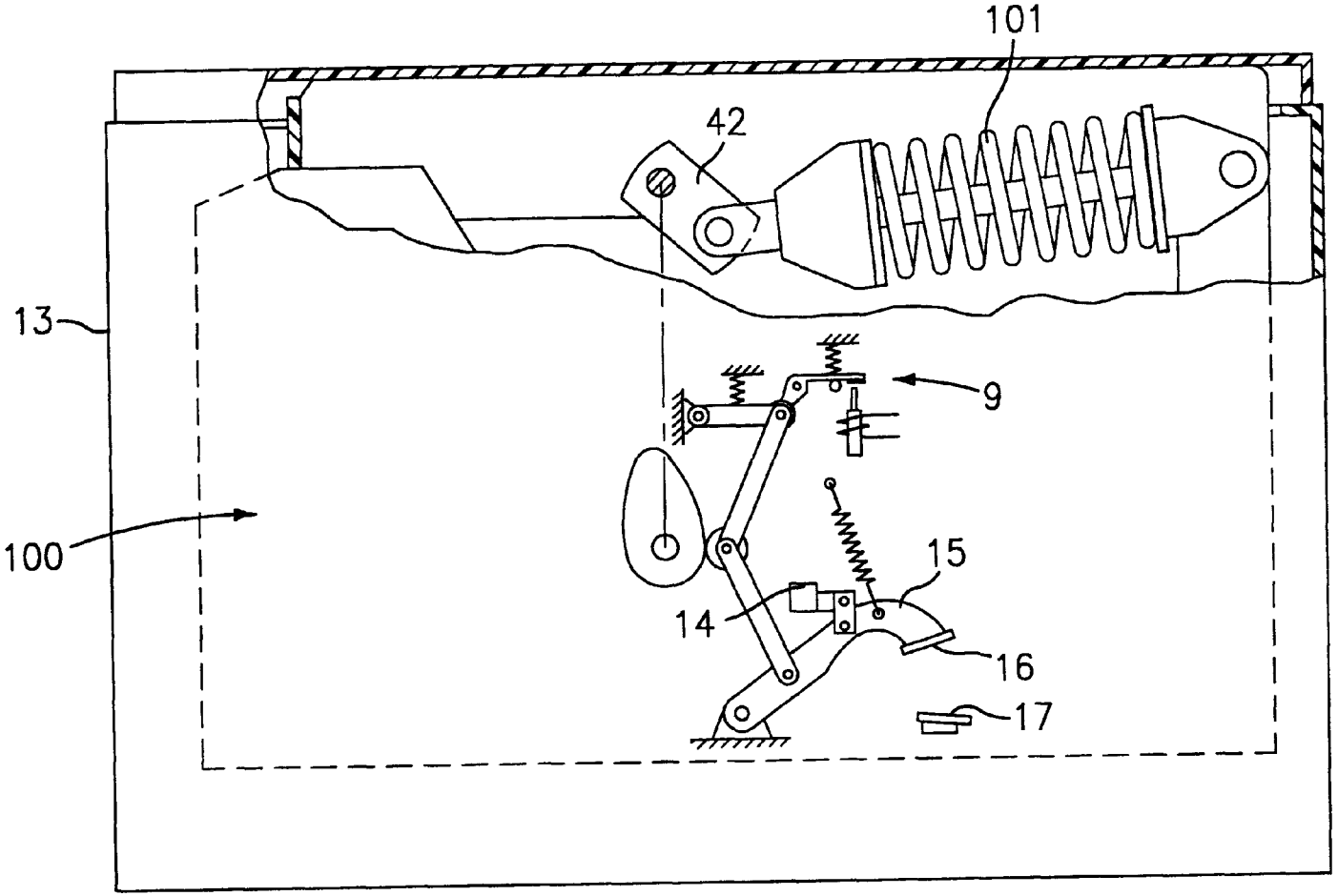
FIG. 1A is a side view in partial section of the circuit breaker of Figure showing a circuit breaker closing spring and a tip unit.

The operating mechanism 100 shown in FIG. 1A includes trip mechanism 9 which interacts with the operating mechanism to open contacts 16, 17 and further includes closing spring 101 which is charged via coupling assembly 42 and also interacts with the operating mechanism to close the contacts.

Figure 2:
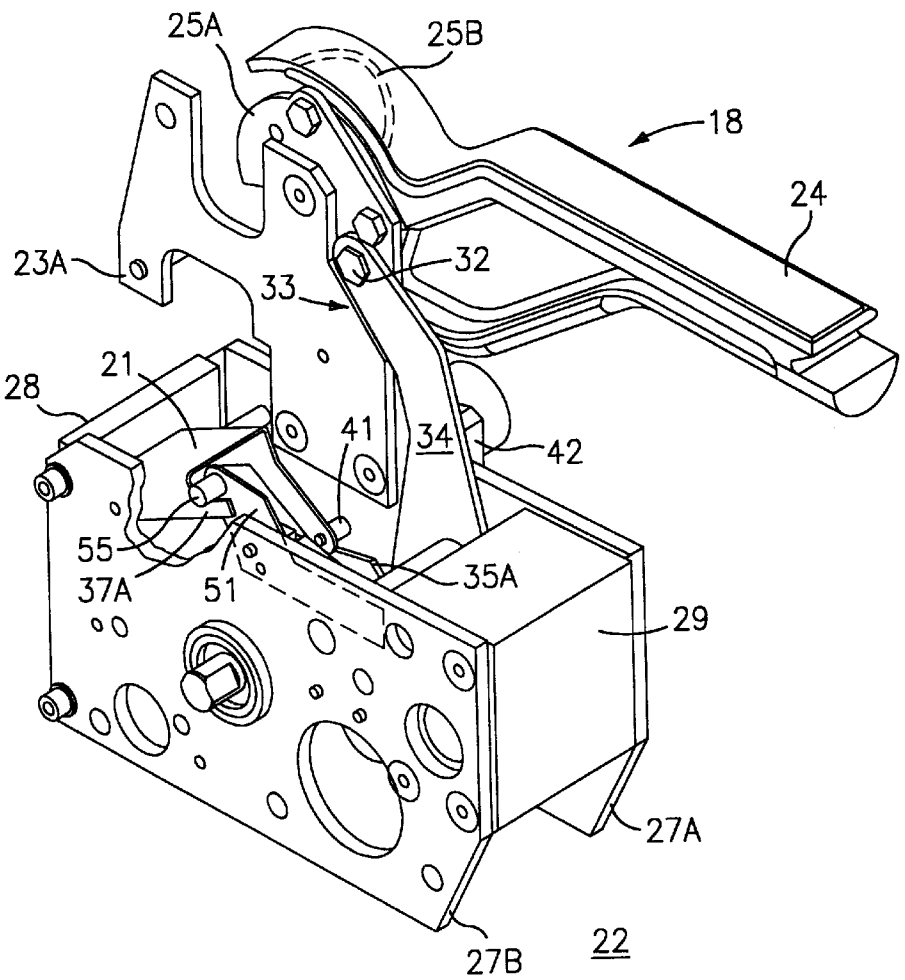
FIG. 2 is an enlarged top perspective view of the closing springs manual charging arrangement of FIG. 1.
Figure 3:
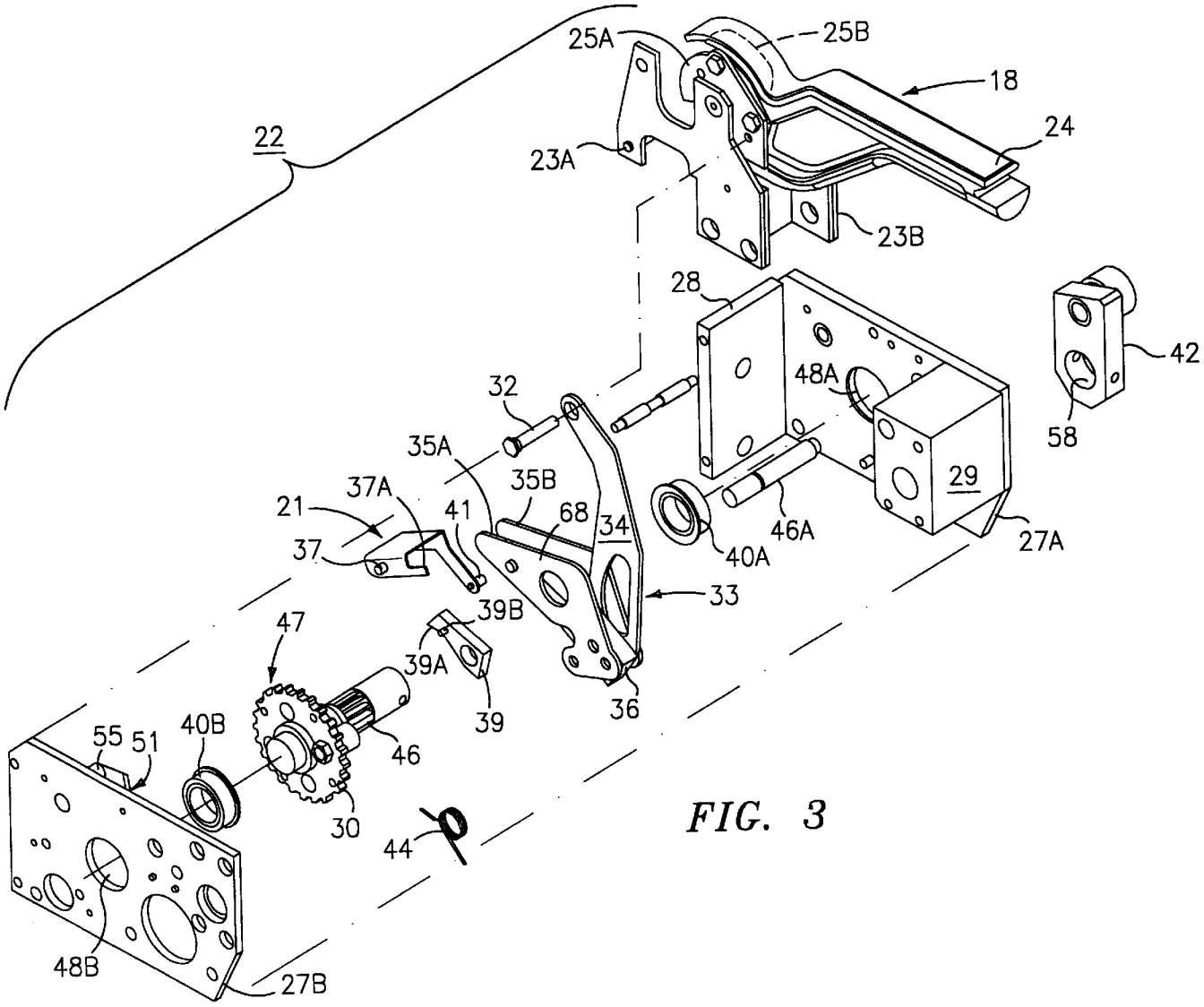
FIG. 3 is an en exploded top perspective view of the components within the closing springs manual charging arrangement of FIG. 2.

The ratchet mechanism 22 according to the invention is shown in FIGS. 2 and 3 wherein the operating handle 18 includes a handle extension 24 at one end for manual manipulation of a pair of handle pivot plates 25A, 25B at an opposite end as described in the aforementioned U.S. patent application Ser. No. 08/863,649. The handle pivot plates are assembled onto a pair of connector plates, 23A, 23B which are attached to a pair of opposing sideframes 27A, 27B which are separated by means of block spacers 28, 29. The charging crank 33 includes charging link 34 which is connected to the pivot plate 25A via pin connector 32 further and includes a pair of charging cams 35A, 35B and intervening charging pawl 36 that interacts with the charging shaft 46 and charging shaft pivot 46A to charge the air circuit breaker closing spring 101. The charging pawl 36 connects with the charging cams 35A, 35B and with the charging shaft 46 and interact with the circuit breaker operating mechanism 100 by means of the operating mechanism coupling assembly 42 as described in the aforementioned U.S. patent application Ser. No. 08/863,649. The holding pawl 39 interacts with the teeth 30 on the charging gear 47 by means of a tine 39A to allow rotation of the charging shaft 46 in the manner described within the earlier arrangement described in the aforementioned U.S. Pat. No. 4,167,988. The holding pawl return spring 44 is retained at one end against the anchor pin 39B extending from the holding pawl 39 and is retained at an opposite end by means the sideframe 27B. Similar bearings 40A, 40B on the opposite sides of the charging crank 33 receive the charging shaft 46 to support the charging shaft 46 by capture of the bearing within the apertures 48A, 48B formed within the sideframes 27A, 27B and within the aperture 58 formed within the operating mechanism coupling assembly 42. A similar locking latch 51 controls the position of the anchor pin 39B to permit the holding pawl 39 in and out of engagement with the teeth 30 on the charging gear 47, as within the earlier arrangement. The ratchet mechanism 22 of the invention differs from the earlier arrangement by the imposition of a latch release lever 21 intermediate the locking latch 51 and the holding pawl 39 and the provision of a camming surface 68 upon the charging cam 35A to position the cam pin 41 on the latch release lever 21. This arrangement allows the holding pawl 39 to return to the charging position upon uptake of the operating handle 18 to recharge the closing spring without having to open the latch assembly enclosure to manually access the locking latch 51. The latch release lever 21 defines a U-shaped plate 37 on the top thereof and a tab 37A formed thereon to capture the locking latch cam pin 55 as shown in FIG. 2.

Figure 4:
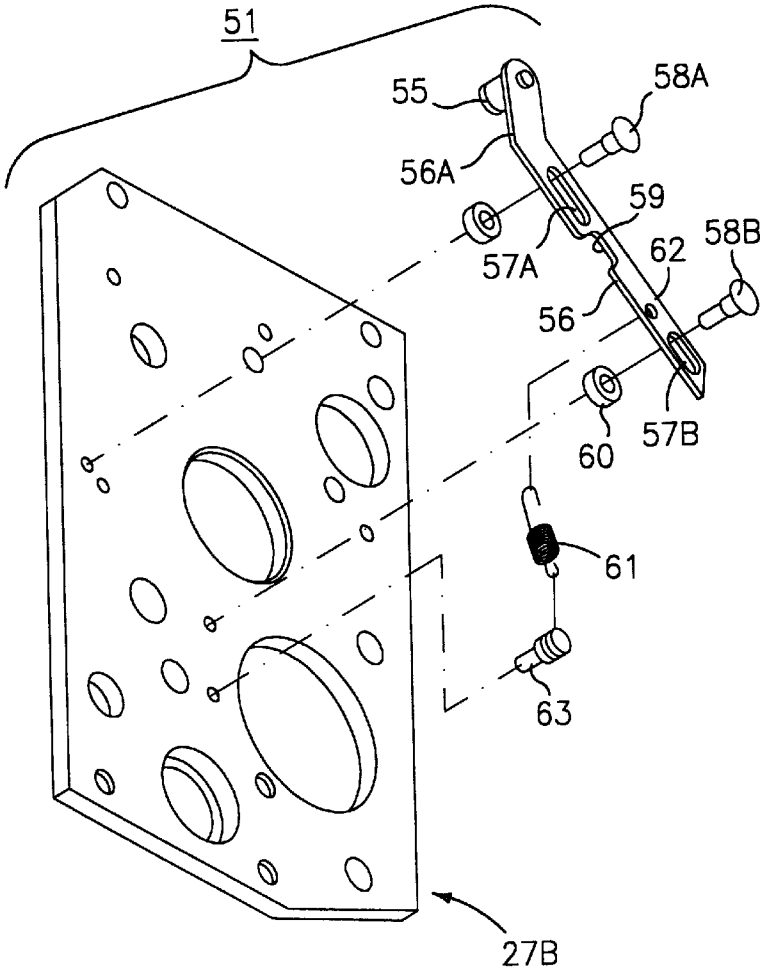
FIG. 4 is an enlarged top perspective view of the components within the locking latch in the closing springs manual charging arrangement of FIG. 2.

The locking latch 51 is shown in FIG. 4 to consist of a rectangular latch plate 56 having an off set 56A at one end to which the locking latch cam pin 55 is attached. A pair of elongated slots 57A, 57B receive corresponding locking latch guide pins 58A, 58B that are attached to the sideframe 27B via spacers 60 to allow translatory motion of the latch plate 56 in both directions along the plane of the sideframe. A slot 59 formed in the center of the latch plate 56 provides clearance for the anchor pin 39B (FIG. 3) as the operating handle 18 is operated to rotate the charging gear 47 and charge the closing spring. The locking latch return spring 61 attaches to the sideframe 27B at one end by means of the return spring post 63 and to the latch plate 56 at the opposite end by means of the return spring aperture 62.

Figure 5:
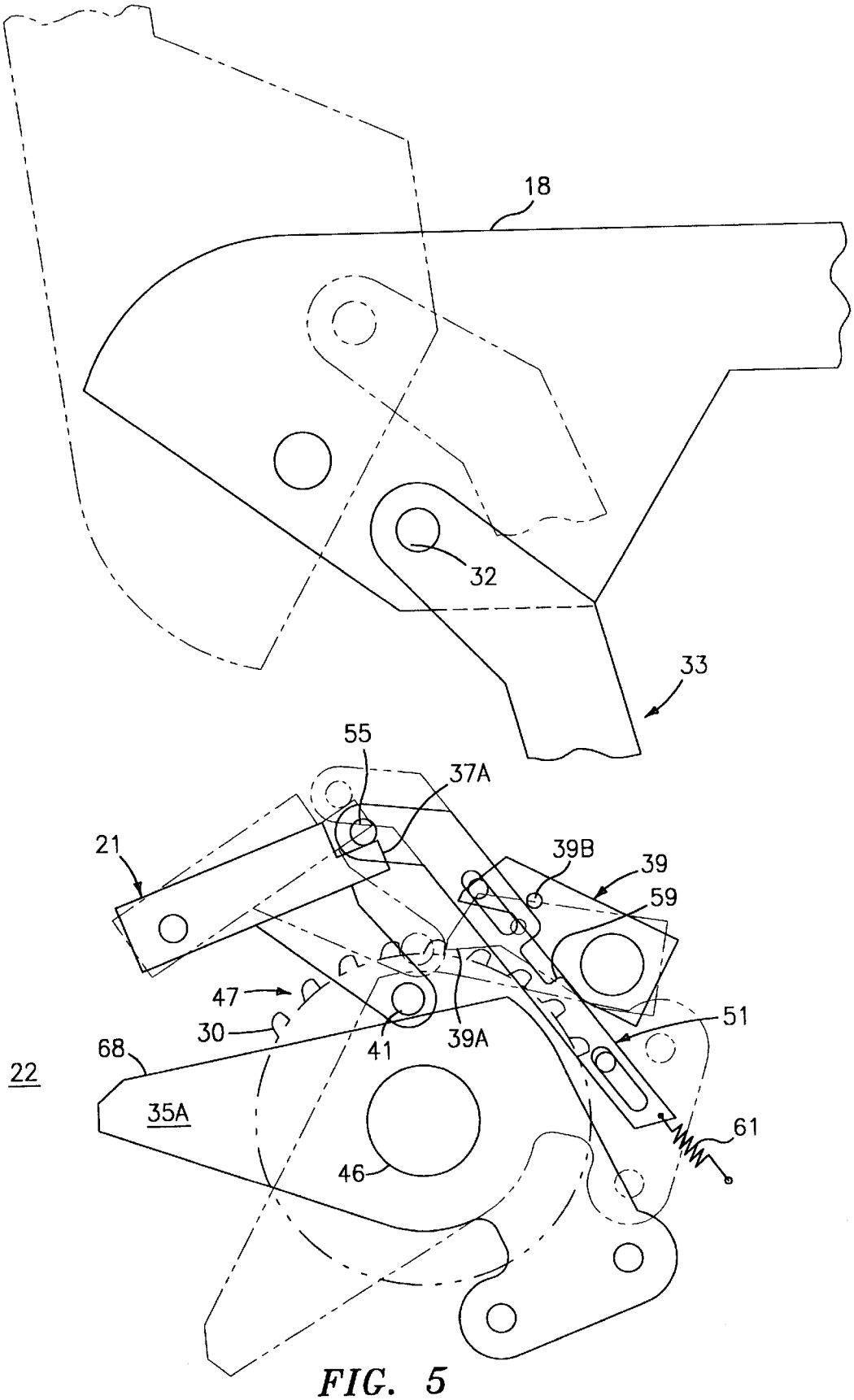
FIG. 5 is an enlarged side view of some of the operating components within the closing springs manual charging arrangement of FIG. 1.

The operation of the latch release lever 21 to release the holding pawl 39 when the operating handle 18 is rotated to drive the ratchet mechanism 22 via the charging crank 33 and pin connector 32 is best seen by referring now to FIG. 5 where the condition of the operating handle and the ratchet mechanism components is depicted in solid lines for the hold-out condition of anchor pin 39B and the release condition is depicted in phantom. As described within the aforementioned U.S. Pat. No. 4,167,988, the anchor pin 39B moves within the guide slot 59 in the locking latch 51 under the return bias of the return spring 61 during rotation of the charging shaft 46 in the process of charging the closing spring. When the closing spring is released, further application of closing forces moves the anchor pin 39B out of the slot 59 to the position shown in solid lines and rotates the tine 39A at the end of the holding pawl 39 out of engagement with the teeth 30 on the charging gear 47. In accordance with the invention, when an attempt is made to recharge the closing spring, the circuit breaker operating handle 18 is first rotated to the counter-clockwise position, as indicated in phantom. The charging cam 35A which seats the cam pin 41 upon the camming surface 68, rotates in the counter-clockwise direction to rotate the latch release lever 21 in the same direction. The tab 37A on the end of the latch release lever 21 carries the locking latch cam pin 55 counterclockwise and drags the locking latch 51 in the indicated direction allowing the anchor pin 39B to drop back within the slot 59 and return the holding pawl 39 to the charging position whereby the holding pawl tine 39A returns to operative engagement with the teeth 30 on the charging gear 47 to hold the charging shaft 46 when the handle 18 is moved in the clockwise direction to charge the closing spring.

It has thus been shown that a charging cam and holding pawl for assisting in the charging of an air circuit breaker closing spring can be automatically positioned to an non-active position for preventing damage occurrence to the charging cam and holding pawl components when the circuit breaker closing springs are released without requiring manual intervention for placing the holding pawl and charging cam into an active position before the closing springs become re-charged.

We claim:

1. A ratcheting mechanism for circuit breaker contact closing springs comprising:

a circuit breaker operating handle pivotally mounted intermediate a pair of opposing side frames;

a pivot plate attached to said operating handle and arranged for pivotal rotation in unison with said operating handle;

a charging shaft supported intermediate said side frames and arranged for interacting with a circuit breaker closing spring;

a charging crank having one end attached to said pivot plate and an opposite end engaging said charging shaft;

a holding pawl intermediate said side frames controlled by a locking latch and interacting with a charging gear on said charging shaft to prevent said charging shaft from rotating in a reverse direction wherein said charging gear includes circumferential teeth formed thereon and wherein said holding pawl includes a tine, said tine being retained by said circumferential teeth when said operating handle rotates said charging shaft and wherein said charging crank includes a charging link;

a cam connecting with said charging link, and arranged for rotation in unison with said charging link; and a latch release lever intermediate said side frames, said release lever having a cam pin at one end thereof for interacting with said cam and a latch release tab at an opposite end for interacting with said locking latch.

2. The ratcheting mechanism of claim 1 wherein said locking latch comprises an elongated latch plate extending between said sideframes having first and second ends and defining a retainer slot intermediate said first and second ends, said retainer slot adapted for retaining a holding pawl pin extending from said holding pawl when said holding pawl tine is retained by said circumferential teeth.

3. The ratcheting mechanism of claim 2 wherein said holding pawl pin is outside said retainer slot when said holding pawl tine is away from said circumferential teeth.

4. The ratcheting mechanism of claim 3 wherein a locking latch cam pin is captured by said latch release tab for lifting said locking latch pin in response to rotation of said latch release lever.

5. The ratcheting mechanism of claim 4 wherein a charging cam surface lifts said latch release pin to rotate said latch release lever and motivate said locking latch in said first plane whereby said holding pawl pin drops within said locking latch retainer slot and rotates said holding pawl tine into contact with said circumferential teeth.

6. The ratcheting mechanism of claim 5 wherein said holding pawl is biased into engagement with said charging gear by means of a torsion spring.

7. A circuit breaker comprising:

a support frame;

an operating mechanism within said support frame, said operating mechanism including contact closing springs;

a moveable contact arm interacting with said contact closing springs for opening and closing a pair of contacts;

a trip unit interacting with said operating mechanism for articulating said operating mechanism to separate said contacts upon command; and a ratcheting mechanism connecting with said operating mechanism for charging said closing springs, said ratcheting mechanism including a circuit breaker operating handle pivotally mounted intermediate a pair of opposing side frames, a pivot plate attached to said operating handle and arranged for pivotal rotation in unison with said operating handle;

a charging shaft supported intermediate said side frames and arranged for interacting with a circuit breaker closing spring, a charging crank having one end attached to said pivot plate and an opposite end engaging said charging shaft, and a holding pawl intermediate said side frames controlled by a locking latch and interacting with a charging gear on said charging shaft to prevent said charging shaft from rotating in a reverse direction wherein said charging gear includes circumferential teeth formed thereon and wherein said holding pawl includes a tine, said tine being retained by said circulmferential teeth when said operating handle rotates said charging shaft and wherein said charging crank includes a charging link;

a cam connecting with said charging link, and arranged for rotation in unison with said charging link; and a latch release lever intermediate said side frames, said release lever having a cam pin at one end thereof for interacting with said cam and a latch release tab at an opposite end for interacting with said locking latch.

8. The circuit breaker of claim 7 wherein said locking latch comprises an elongated latch plate extending between said sideframes having first and second ends and defining a retainer slot intermediate said first and second ends, said retainer slot adapted for retaining a holding pawl pin extending from said holding pawl when said holding pawl tine is retained by said circumferential teeth.

9. The circuit breaker of claim 5 wherein said holding pawl pin is outside said retainer slot when said holding pawl tine is away from said circumferential teeth.

10. The circuit breaker of claim 9 wherein said locking latch is captured by said latch release tab for lifting said locking latch pin in response to rotation of said latch release lever.

11. The circuit breaker of claim 10 wherein a charging cam surface lifts said latch release pin to rotate said latch release lever and motivate said locking latch in said first plane whereby said holding pawl pin drops within said locking latch retainer slot and rotates said holding pawl tine into contact with said circumferential teeth.

12. The circuit breaker of claim 11 wherein said holding pawl is biased into engagement with said charging shaft by means of an extension spring.

* * * * *

UNITED STATES PATENT AND TRADEMARK OFFICE

CERTIFICATE OF CORRECTION

PATENT NO. : 5,910,650
DATED : June 8, 1999
INVENTOR(S) : Castonguay, et. al.

It is certified that error appears in the above-identified patent and that said Letters Patent is hereby corrected as shown below:

Column 1, Line 55, delete "Docket No. 41PR-7413" and substitute -- Serial No. 08/863,649 --.

Column 2, line 28, delete "en" after the word "an".

Signed and Sealed this
Thirtieth Day of November, 1999

*Attest:*

*Attesting Officer*

Q. TODD DICKINSON

*Acting Commissioner of Patents and Trademarks*